United States Patent [19]

Joseph

[11] 3,934,638

[45] Jan. 27, 1976

[54] CONTINUOUS CASTING PROCESS

[75] Inventor: Robert W. Joseph, Schererville, Ind.

[73] Assignee: Inland Steel Company, Chicago, Ill.

[22] Filed: Feb. 8, 1971

[21] Appl. No.: 113,156

[52] U.S. Cl. ..... 164/89
[51] Int. Cl.[2] ..... B22D 11/16
[58] Field of Search ..... 164/281, 82, 89

[56] References Cited

UNITED STATES PATENTS

| | | | |
|---|---|---|---|
| 3,371,704 | 3/1968 | Astrov et al. | 164/281 |
| 3,375,863 | 4/1968 | Atkin et al. | 164/281 |
| 3,517,726 | 6/1970 | Mills et al. | 164/281 X |
| 3,578,064 | 5/1971 | Mills et al. | 164/281 |
| 3,587,719 | 6/1971 | Schrewe et al. | 164/281 |

OTHER PUBLICATIONS

"Mannesmann Submerged Nozzles," 33 Magazine, Schrewe et al., Oct. 1969, pp. 263–277.

*Primary Examiner*—Francis S. Husar
*Assistant Examiner*—John E. Roethel
*Attorney, Agent, or Firm*—Hibben, Noyes & Bicknell

[57] ABSTRACT

A process of continuous casting a ferrous metal bloom or billet free of axial looseness and voids and having good chemical homogeneity in the central axial zone in which a molten ferrous metal is maintained in a tundish which supplys the molten metal to a continuous casting mold through a mold feeding nozzle at a superheated temperature above the liquidus temperature of the ferrous metal sufficiently high to avoid objectionable freezing or skulling in both the tundish and the mold feeding nozzle but not at such an elevated temperature that the molten metal cannot be cooled in the continuous casting mold to at least the liquidus temperature of the ferrous metal before the metal descends into the deep liquid core zone of the continuous casting. In the preferred embodiment cooling of the superheated ferrous metal in the continuous casting mold to at least the liquidus temperature before the molten metal enters the deep liquid core zone thereof is effected by feeding the molten ferrous metal superheated above the liquidus temperature from the tundish into the mold through a tubular feeding nozzle having the lower end submerged below the surface of the molten metal in the mold and discharging the molten metal into the mold in a plurality of transversely flowing streams which directly contact the inner surface of the mold wall and distribute the molten metal over an area of the mold extending between the upper surface of the molten metal and the upper edge of the air gap which is formed between the outer surface of the solidifying casting shell and the mold wall. When casting 1017 steel in accordance with the disclosed process the temperature of the molten metal in the tundish can be maintained at a superheated temperature up to about 20° F. above the liquidus temperature, and the 1017 steel is preferably maintained in the tundish at a superheated temperature of at lest 5° F. above the liquidus temperature and not substantially in excess of about 20° F. above the liquidus temperature thereof.

7 Claims, 10 Drawing Figures

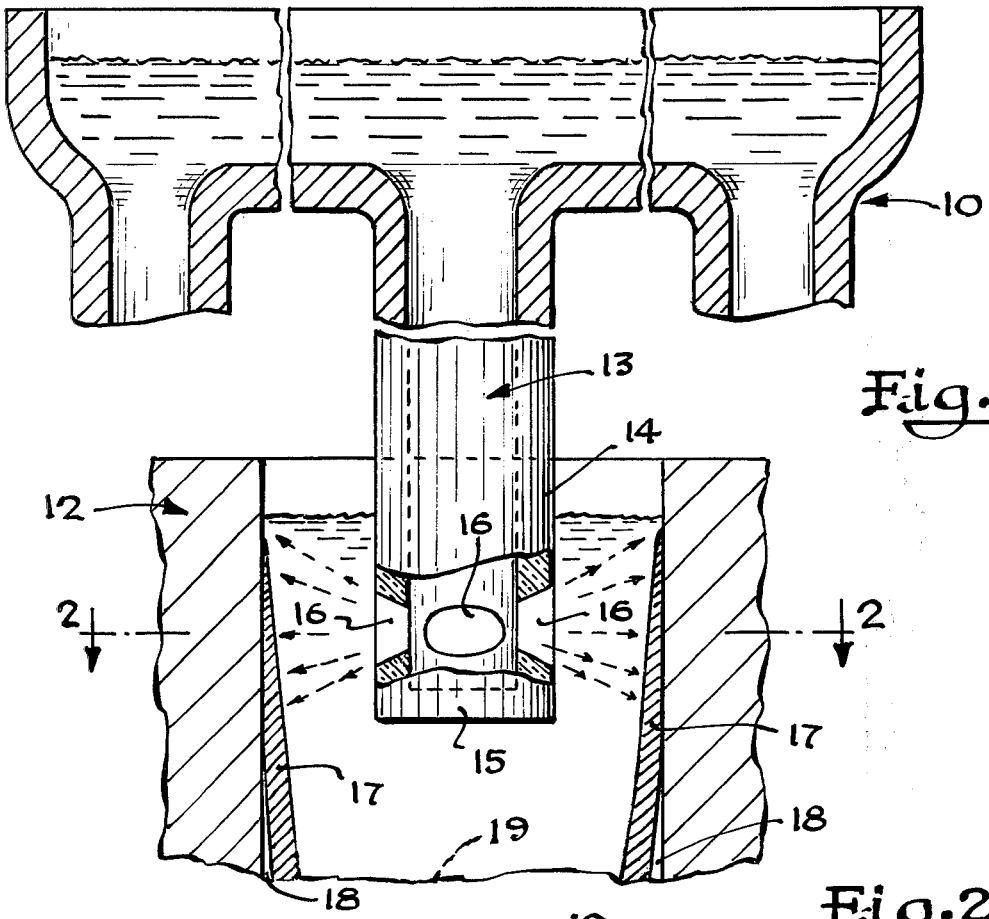
Fig.1
Fig.2
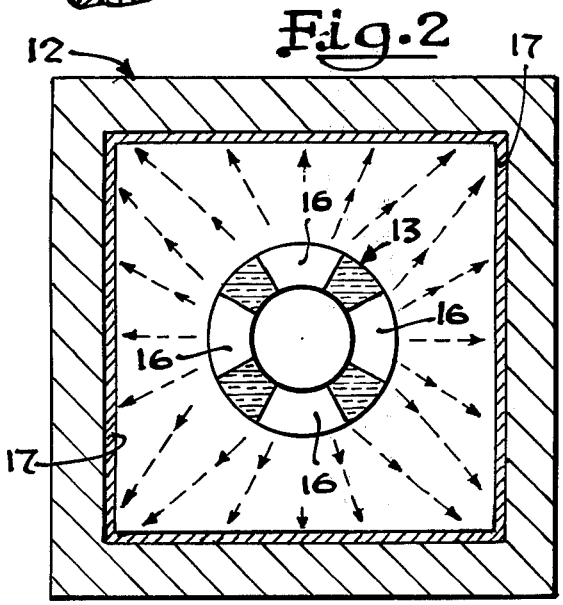
Fig.3
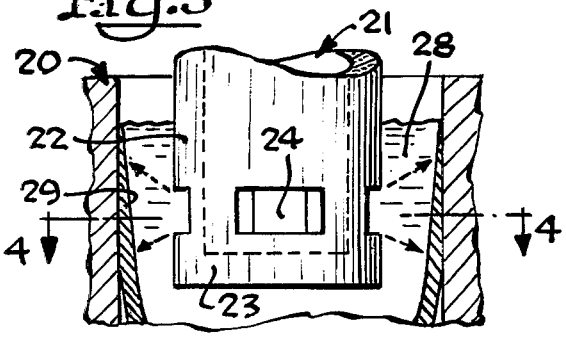
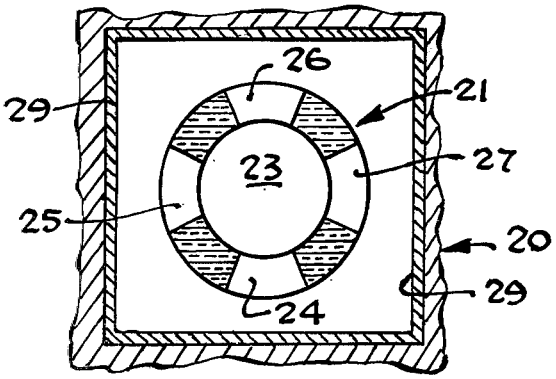
Fig.4
Inventor
Robert W. Joseph
By Hibben, Noyes & Bicknell
Attorneys Fig.5
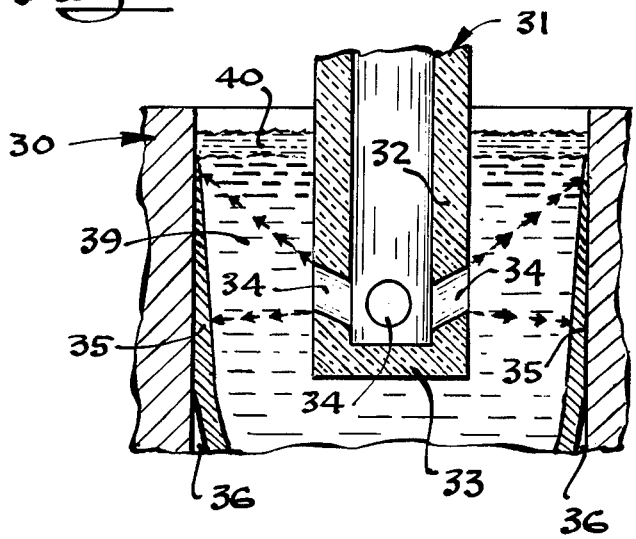
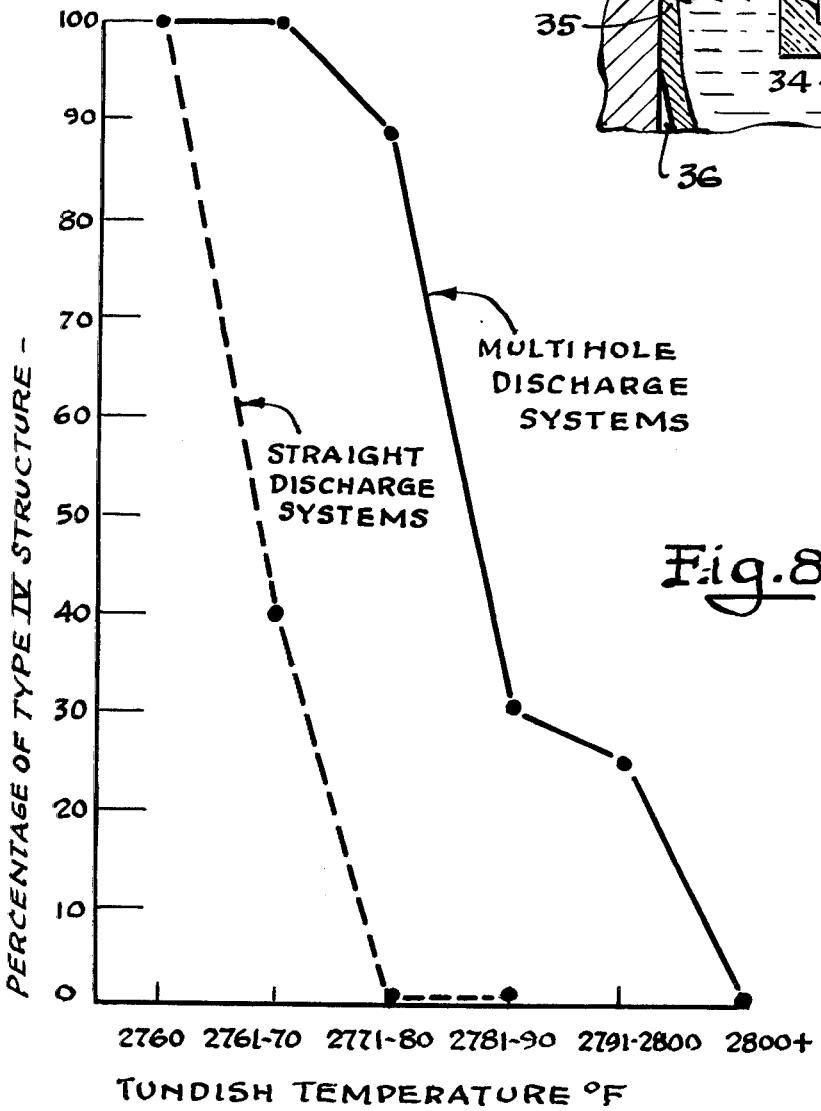
Fig.8
Inventor
Robert W. Joseph
By Hibben, Noyes & Bicknell
Attorneys Inventor
Robert W. Joseph
By Hibben, Noyes & Bicknell
Attorneys

CONTINUOUS CASTING PROCESS

The present invention relates generally to an improved process for the continuous casting of steel and the like high melting point ferrous metal compositions and more particularly to a process of continuous casting of steel which reduces the frequency of forced shut downs of the continuous casting apparatus due to freezing of steel in the tundish and/or casting nozzle and which at the same time produces a continuous steel casting having superior quality internal structure and good chemical homogenity.

Heretofore, continuous steel castings having an internal structure and chemical homogeneity substantially free of axial defects and suitable for special quality uses, such as hot rolled and cold finished carbon steel bars for applications involving cold forging, cold extrusion, cold drawing, machining and heat treating, have been difficult to produce consistently by means of continuous casting. And, it is particularly important to produce the proper as-cast internal structure when casting blooms and billets intended for use as hot rolled and cold finished bars which must have restrictive requirement (RR) quality and multiple restrictive requirement (MRR) quality, since the internal defects in the castings remain even after a reduction ratio of 7:1 in the rolled rods and bars.

Among the most objectionable internal defects frequently found in continuous cast billets and blooms, even those heretofore considered of good quality, are those found in the central or axial zone. When the central zone, for example, has a small diameter and the non-metallic impurities and inclusions concentrated along the longitudinal axis and in the immediate adjacent areas, the casting generally exhibits a "dark center" in a standard deep etch test and may also have axial looseness and voids which in some instances form an axial shrinkage cavity or "pipe". It is highly desirable to maintain at a minimum and preferably eliminate from the continuous castings (1) the axial shrinkage cavity or "pipe" (2) the "dark center" portion in the axial section of the casting, (3) the sulphur-rich melt-filled cracks which are formed when the billets and blooms are deformed or subjected to thermal stresses before completely solidified and resulting in segregated streaks within the interior of the casting, and (4) the poor chemical homogeneity in the interior of the casting, as these defects in the internal structure significantly reduce the quality of a billet or bloom and make the castings entirely unsuitable for certain special quality uses.

It has heretofore been suggested as desirable to maintain the molten steel in the tundish at a minimum temperature consistent with good pouring in order to produce continuous castings having less segregation and an improved solidification structure. Various means have been used for controlling the temperature of the molten metal entering the continuous casting mold, such as providing argon stirring with a heavy slag cover in the ladle to minimize temperature variations in the stream of metal during the casting operation. Also, temperature control means have been provided in the tundish and associated with the feeding nozzle conveying the molten metal from the tundish to the continuous casting mold. None of these temperature control means, however, are capable of maintaining the temperature of a molten ferrous metal in the tundish or mold feeding nozzle at or just above the melting temperature of the ferrous metal. Consequently, it has been considered necessary from a practical operating standpoint to maintain the steel in the tundish at a temperature much higher than the temperature at which the steel begins to solidify. For example, it has been suggested that the temperature of the molten steel in the tundish should be about 40°- 50°F above the temperature at which the steel freezes with a maximum tundish temperature of 2830°F for 1017 steel. It has also been stated that the temperature range suitable for the continuous casting of steel is between about 68° and 140°F (20–60°C) above the liquidus temperature of the steel being cast. The continuous castings produced in accordance with these prior art practices, however, consistently exhibit axial defects, particularly in billet and bloom castings, making these castings widely unacceptable for use in many applications requiring superior quality internal structure, such as where very severe forming is necessary and for other critical end uses.

It is, therefore, an object of the present invention to provide an improved process of continuously casting steel and the like high melting point ferrous metals which consistently and economically produces continuous steel castings, particularly continuous bloom and billet castings, characterized by the substantial absence of axial voids and segregation of impurities and which exhibit sound centers and good chemical homogeneity, while avoiding work stoppages due to skulling of the molten steel in the tundish and/or mold feeding nozzle.

It is a further object of the present invention to provide an improved continuous casting process for steel and the like high melting point ferrous metals wherein the molten ferrous metal can be maintained in the tundish at a temperature substantially above the temperature at which skulling occurs in the casting nozzle and/or tundish and still consistently produce continuous ferrous metal castings having special quality internal structure substantially free of axial voids and concentrations of segregated impurities in the axial zone.

It is still another object of the present invention to provide an improved process for continuously casting steel in a multiple strand continuous casting apparatus in which each of the strands of a multiple strand continuous steel casting apparatus consistently has superior internal structure and good chemical homogeneity without having to shut down or otherwise interrupt the continuous casting operation at frequent intervals due to freezing of the steel in the tundish and/or mold feeding nozzle.

It is also an object of the present invention to provide an improved process of continuous casting steel billets and blooms which consistently have special quality internal structures, good surface properties and good chemical homogeneity without frequent stoppages of the continuous casting apparatus due to objectionable skulling of the molten steel in the tundish and/or mold feeding nozzle.

Other objects of the present invention will be evident to those skilled in the art from the following detailed description and claims when read in conjunction with the accompanying drawings; wherein:

FIG. 1 is a fragmentary schematic side elevational view partially in vertical section of a continuous casting bloom mold and mold feeding nozzle assembly embodying the present invention;

FIG. 2 is a schematic horizontal sectional view taken along the line 2—2 of FIG. 1;

FIG. 3 is a fragmentary schematic side elevational view partially in vertical section of a modified form of continuous casting mold feeding nozzle and bloom mold assembly embodying the present invention;

FIG. 4 is a fragmentary schematic horizontal sectional view taken along the line 4—4 of FIG. 3;

FIG. 5 is a fragmentary vertical sectional view of a still further modified form of continuous casting mold feeding nozzle and bloom mold assembly operatively disposed in accordance with the present invention;

Figure 7:
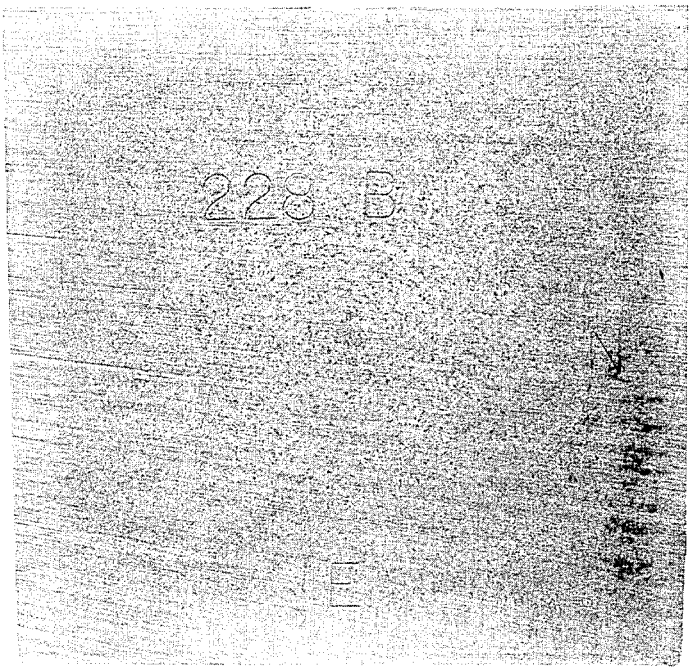
FIG. 7 is a photograph of a deep etched transverse section of an as-cast continuous bloom casting of 1017 steel showing typical Type IV structure.
Figure 7A:
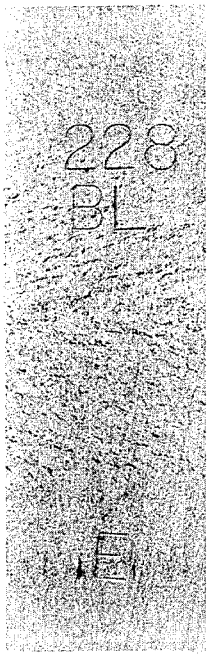

FIG. 7A is a photograph of a deep etched longitudinal section of an as-cast bloom of casting of FIG. 7 showing typical Type IV structure; and FIG. 8 is a graphic representation of the relationship between the precentage of Type IV structure produced with 1017 steel in continuous bloom castings within the indicated ranges of temperature of the metal in the tundish when continuous casting using the multihole lateral discharge system of the present invention and a conventional straight discharge system of the prior art.

The objects of the present invention are broadly achieved by maintaining a molten ferrous metal casting material in the tundish at a moderate degree of superheat above the liquidus temperature of the steel and effecting cooling of the moderately superheated molten ferrous metal to substantially the liquidus temperature of the metal or lower immediately after the metal is discharged into a conventional continuous casting mold and before the metal enters the deep liquid core of the continuous casting. Thus, it has been discovered that superior continuous castings free of axial voids and axial concentration of impurities can be produced only if a molten ferrous metal entering the deep liquid core which characteristically forms in the axial portion of a ferrous metal casting is substantially at or below the liquidus temperature of the ferrous metal being cast.

Heretofore, those skilled in the art failed to recognize the criticality of having the molten metal which enters the deep liquid core of a ferrous metal casting at or below the liquidus temperature of the metal being continously cast, and that the essential reduction in the temperature of the entering ferrous metal to the liquidus temperature or below can be achieved by controlling the flow of the molten metal into the continuous casting mold through a submerged nozzle when the molten ferrous metal supplied to the submerged nozzle has a moderate degree of superheat which is sufficient to avoid "skulling" in the tundish and nozzle and yet capable of being rapidly cooled to the liquidus temperature or lower before the ferrous metal enters the deep liquid core area of the casting. Continuous castings produced in accordance with the foregoing principle have superior internal structure and are free of objectionable axial segregation, axial looseness and piping, while at the same time avoiding freezing of the metal in the tundish and/or mold feeding nozzle.

More particularly, it has been discovered that when a molten metal is maintained in the tundish at a controlled degree of superheat sufficiently high to avoid an objectionable amount of skulling, cooling of the superheated molten ferrous metal can be effected within the upper end of a continous casting mold and the temperature of the molten metal can be lowered to at least the liquidus temperature thereof before the molten metal descends into the deep liquid core zone, which in ferrous metal continous casting extends downwardly a considerable distance within the interior of the casting, by discharging the molten metal from the tundish into a continuous casting mold through a submergible mold feeding nozzle in streams which cause substantially all of the inflowing metal immediately after discharge from the nozzle to contact directly, uniformly, and continuously the interior lateral surfaces of the continuous casting shell which is initially formed in the area within the mold where there is maximum rate of heat removal from the mold.

Ferrous metal continuous castings produced in accordance with conventional continuous casting procedures have relatively poor internal structure when the steel is maintained in the tundish at a temperature sufficiently high to avoid an objectionably high incidence of skulling and at a temperature more than a few degrees of superheat in excess of the liquidus temperature of the molten metal, because superheated ferrous metal is allowed to enter the deep liquid core of the casting. From the data of Table II shown graphically in FIG. 8, when continous casting 1017 steel using a straight discharge system with the metal in the tundish having as little as about 5°F. of superheat, about 60 percent of the resulting product has the very objectionable Type I internal structure and fails to exhibit the desired Type IV internal structure which will be described in detail hereinafter. However, the adverse effects on the internal structure of a ferrous metal normally produced in conventional continous casting processes when the ferrous metal in the tundish has a temperature sufficiently high to consistently prevent skulling are substantially avoided when casting in accordance with the present method, even when the molten metal in the tundish is superheated as much as about (20°F) above the liquidus temperature of the ferrous metal. Thus, it has been found that unusually good casting results are provided by directing the flow of a ferrous metal, which is maintained in the tundish at a superheated temperature sufficiently to avoid objectionable skulling and up to about 20°F above the liquidus temperature, from the tundish into a conventional continous casting mold through a mold feeding nozzle having a plurality of lateral discharge openings in the submerged lower lateral wall section thereof so that the molten metal flows in generally radial streams outwardly from the lateral discharge openings directly into contact with an area extending generally from about the level of the molten metal in the mold, which corresponds when casting a ferrous metal to about the uppermost portion of the solidifying casting shell, downwardly to include the area of the casting shell where there is only a very thin layer of initially solidifying metal. Generally, the area contacted by the streams of molten metal has a maximum heighth of only about six inches below the upper edge of the solidifying casting shell in a standard 8 × 8 inch bloom continuously cast and extends preferably no lower than the level of separation of the casting shell and the mold where the air gap begins to form. As shown in FIGS. 1–5 of the drawing illustrating a preferred method of practicing the present invention, the generally transversely flowing streams of metal contact the inner surfaces of the solidifying shell uniformly over an area between the upper edge of the solidifying shell and the level of separation of the shell and the mold wall where an air gap is initially formed between the mold wall and the outer surface of the casting.

By employing the herein disclosed method of introducing the molten metal into the continuous casting mold in a multiplicity of controlled streams in combination with maintaining the molten metal in the tundish at a moderate degree of superheat which is sufficiently high so that skulling in the mold feeding nozzle is avoided but still not so excessive that the temperature of the metal after entering the mold can not be reduced to its liquidus temperature or below before the metal settles into the deep liquid core area of the ferrous metal casting, a very high yield of superior continuous castings substantially free of axial segregation of impurities, axial looseness and piping can be produced. With the present method the molten metal in the tundish can be superheated to a temperature up to about 20°F above the liquidus temperature of the steel being cast and still provide castings having superior internal structure. The fact that a substantial increase in the rate of heat removal from the continuous casting mold is obtained when employing the method of the present invention as compared with a conventional straight axial discharge system is confirmed by the data of the following Table I showing the results of heat balance studies when casting 1017 steel with the apparatus of FIG. 5 and a conventional straight discharge system wherein all the casting conditions except the mold feeding means were the same, including mold structure, slag composition, and tundish metal temperature and at a constant casting rate of 80 inches per minute:

TABLE I

| | Multihole Horizontal Discharge System | Vertical Discharge System |
|---|---|---|
| BTU withdrawn/lb. steel: | 42.5 | 38.0 |

Furthermore, when the difference in the amount of heat withdrawn which amounts to 4.5 BTU/lb. is divided by 0.188 BTU/lb./°F, the specific heat of liquid steel at 2800°F, it is evident that approximately 24°F more heat was removed from the mold when using the multihole horizontal discharge system of the present invention. The foregoing calculation of the increased amount of heat removed (24°F) by the system of the present invention is in agreement with the 20°F increase observed in the maximum tundish temperatures at which superior internal casting structures were produced when using the multiholed horizontal discharge nozzle employed in accordance with the present invention as compared with a conventional vertical discharge system (see Table II).

In achieving the obejcts of the present invention, as shown in FIGS. 1 and 2 of the drawing, molten steel which is held in a conventional tundish 10 at a temperature up to about 20°F above the liquidus temperature of the steel is conveyed from the tundish 10 into one or more conventional continuous casting molds 12 suitable for casting blooms (8 × 8 inch) by means of an axially disposed tubular submergible nozzle 13 having a cylindrical lateral wall section 14 with an end wall 15 closing the lower end thereof. Four equally spaced lateral discharge passages 16 are formed in the lateral wall section 14 of the nozzle adjacent the lower end wall 15. The discharge passages 16 preferably have a generally oblong elliptic shape and the walls of the passages 16 preferably taper outwardly at an angle of about 15°. The longitudinal axes of the passages 16 extend in a transverse plane through the nozzle 16 and intersect at the longitudinal axis of the nozzle. When forming square castings each of the passages 16 preferably has the same cross-sectional area and is disposed opposite the midpoint of the lateral wall of the mold proximate thereto. When a rectangular casting is being cast, it will be understood that the discharge openings facing the longer side of the mold preferably are wider than the discharge openings facing the narrow walls of the mold. The width of each of the passages 16 is such that the streams of outflowing metal diverge and the molten superheated metal is distributed uniformly over the indicated portion of the inner surface of the solidifying casting shell.

The multihole lateral discharge nozzle 13 is disposed in the mold 12 so that the lateral discharge passages 16 are disposed below the surface of the pool of molten steel in the upper end of the continuous casting mold 12 a distance such that the upper edge of the stream of molten metal which flows from each of the discharge passages 16 contacts the upper edge of the solidifying casting shell 17 with the lower edge of the stream extending downwardly below the surface of the pool of molten metal in the mold but preferably no lower than the level of separation between the solidifying casting shell 17 and the inner surface of the mold where an air gap 18 is formed. By positioning the nozzle 13 within the continuous casting mold 12 in the above manner the molten metal being conveyed from the tundish flows directly from the nozzle 13 into contact with the area of the continuous casting shell from which heat is withdrawn at a maximum rate, and the tempeerature of the metal is lowered to the liquidus temperature or lower before descending into the deep core area or zone 19 of the casting. With the foregoing arrangement the superheated metal from the tundish is cooled at a rate which is much greater than when the molten metal is discharged from a nozzle having an axial discharge outlet, or when the molten metal flows horizontally into direct contact with only a limited section of the casting or mold, or when the molten metal discharged from the nozzle follows a circular path within the upper end of the mold so that the metal is delayed in contacting the surface portions of the mold or casting from which heat is rapidly withdrawn.

In the modified form of the invention shown in FIGS. 3 and 4 of the drawing, molten steel from a tundish (not shown) maintained at a temperature betwen about 5° and 20°F above the liquidus temperature of the steel is conveyed into a continuous casting mold 20 suitable for casting blooms (8 × 8 inch) by means of a tubular submergible nozzle 21 axially disposed in the mold 20. The nozzle 21 has a tubular wall section 22 and an end wall section 23 closing the lower end of the tubular section. Four generally truncated rectangular discharge passages 24, 25, 26 and 27 are provided in the lateral wall section 22 adjacent the lower end wall 23 with the centers of the discharge passages 24, 25, 26 and 27 spaced 90° and lying in a single transverse plane extending through the nozzle 21. The walls of each of the rectangular passages 24, 25, 26 and 27 diverge outwardly at an angle of about 15° with each of the passages preferably having the same cross-sectional area.

As best shown in FIG. 3, the nozzle 21 extends into the pool of molten metal 28 maintained at the upper end of the mold 20 a distance such that the upper edge of the diverging stream of metal flowing from the passages 24, 25, 26 and 27, respectively, contacts the upper edge of the shell 29 of metal solidifying on the inner wall of the mold 20 with the lower edge of the stream contacting the solidifying shell at a point about six inches below the upper edge of the solidifying shell 29 and above the point where the air gap is formed between the mold and the casting.

In the further modified form of the invention shown in FIG. 5 of the drawing, molten steel in a tundish (not shown) which is maintained at a temperature up to about 20°F above the liquidus temperature of the steel is conveyed from the tundish through a surface layer of a fused synthetic slag composition 40 into a continuous casting mold 30 suitable for casting blooms (8 × 8 inch) through a tubular nozzle 31 axially disposed in the mold 30 with the nozzle 31 extending through a layer of a molten synthetic glass-like slag 40 on the upper surface of the molten metal 39 in the mold and into the upper end of the continuous casting shell forming in the upper end of the mold. The nozzle 31 in the form illustrated has a tubular lateral wall section 32 with an internal diameter of about 2 inches and with the lower end thereof closed by wall section 33. Four circular discharge passages 34 having a diameter of about 1 inch are formed in the wall section 32 adjacent the end wall 33 with each passage 34 spaced circumferentially 90°. The longitudinal axis of each of the discharge passages 34 is inclined upwardly forming an angle of 15° with a transverse plane through the nozzle 31. The lower end of the nozzle 31 is disposed below the surface of the pool of molten metal in the mold 30 such that the streams of molten metal which flow outwardly through each of the discharge passages 34 have the upper edge of each of the said streams contacting the upper edge of the solidifying casting shell 35 and the lower edge contacting the shell 35 above the level of separation of the shell 35 from the inner mold wall (i.e. the air gap 36). The streams of molten metal flowing from the passage 34 distribute the molten metal uniformly over the circumference of the solidified casting shell 35 from about the upper edge of the casting shell 35 downwardly a distance extending about 4 inches below the upper edge of the solidified casting shell. This distance will, of course, vary according to the dimensions of the mold, the nozzle and the configuration of the discharge ports of the nozzle and will also depend on the distance between the nozzle and the mold which is largely determined by the size of the section being cast. As in the prior embodiments, the molten metal on contacting the casting shell 35 is cooled to at least the liquidus temperature of the metal or below before descending into the deep liquid core of the casting.

In order to demonstrate the variation in the internal quality of continuous castings with changes in the temperature of the molten metal in the tundish and to further show the effect which the type of discharge system used to introduce the molten metal into the mold has on the internal quality of the castings, a series of 1017 steel blooms were produced in a continuous casting mold using a submerged feeding nozzle which discharged the molten metal at temperatures ranging between about 2750°F and about 2800°F using a multistream lateral discharge system in accordance with the present invention and a further series of steel blooms were produced in a continuous casting mold using a conventional straight or vertical discharge system. The castings were cut into transverse and longitudinal sections and the surfaces were deep etched by contacting with a 1:1 hydrochloric acid aqueous solution heated to 160° -180°F for a period of 15 to 30 minutes. Each of the surfaces were evaluated to determine the type of internal structure formed in each of three zones A, B and C. The outer or A zone comprised the outer ½ inch to ⅝ inch of the casting, the intermediate zone or B zone comprised that portion of the casting extending inwardly from the A zone to within about 1.5 to 2 inches of the longitudinal axis of the casting, and the central essentially circular area of the casting having a diameter of from 3 to 4 inches comprised the C zone. Since the A zone of all the castings had a uniform fine grain structure, the critical basis for classifying the several castings, involved the structure in the B and C zones.

Figure 6:
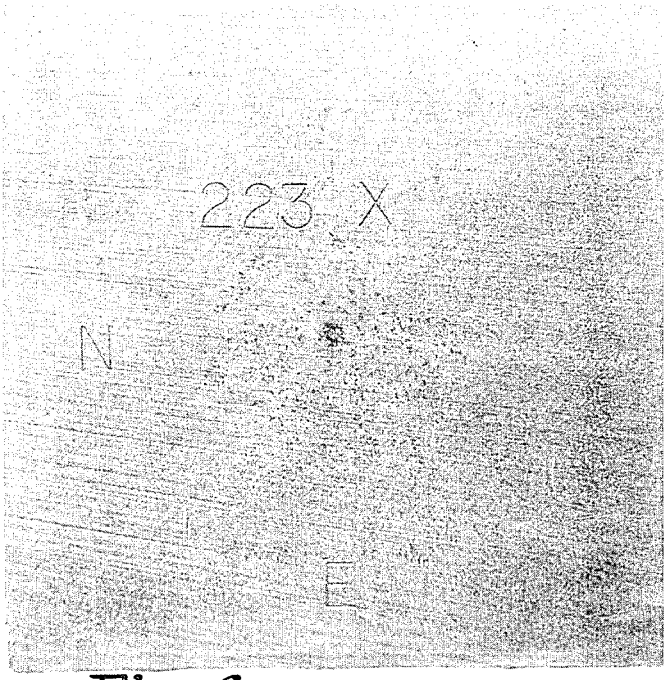
FIG. 6 is a photograph of a deep etched transverse section of an as-cast continuous bloom casting of 1017 steel showing typical Type I structure.

The continuous castings which are classified as Type I are those which had coarse columnar grains in the intermediate or B zone with the central zone or C zone having a small area. In the Type I structure the central or C zone contains some prominent axial porosity and/or etched out inclusions and exhibits typical dark centers, axial looseness or voids which are characteristic of continuous steel bloom and billet castings (see FIGS. 6 and 6A of the drawing).

The continuous casting classified as Type II and Type III structures are those in which the intermediate or B zone contain both coarse and medium size random oriented grains, and where the central or C zone is larger in area than in Type I castings and has only occasional localized porosity and/or concentrations of inclusions.

The Type IV structures are those continuous castings which have fine random oriented grains in the intermediate or B zone and with any porosity and/or inclusions finely dispersed throughout most of the central or C zone which is larger in area than in the other type castings. The central zone in the Type IV castings produced by the present invention are characterized by the absence of voids or axial looseness and concentrations of impurities which cause the dark centers common in most continuous castings.

Figure 6A:
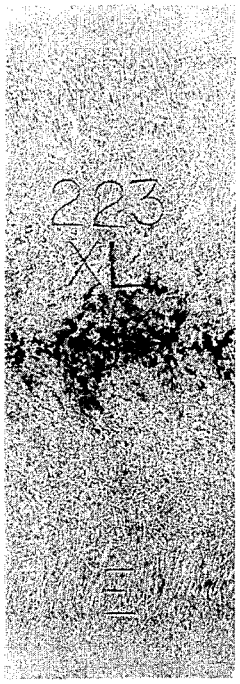
FIG. 6A is a photograph of a deep etched longitudinal section of the as-cast bloom of FIG. 6 showing typical Type I structure.

FIGS. 6, 6A and 7, 7A are photographs of transverse and longitudinal deep etched sections of as-cast blooms showing typical Type I and Type IV internal structures, respectively. The difference between the internal structure of the central or C zones of the Type I and Type IV castings is particularly evident when the longitudinal deep etched sections of FIG. 6A and FIG. 7A are compared.

The Type I internal casting structure in a continuously cast bloom is characterized by an outer chill zone extending inwardly from the surface of the bloom about ½ inch and comprises a fine grain crystalline structure. Extending inwardly from the outer chill zone is an "intermediate zone" which is characterized by a coarse columnar structure having inherent planes of weakness between dendrites in which thermal and/or mechanical stresses can cause the formation of internal cracks which persists into the final rolled steel product.

The central or axial zone is relatively small having a diameter of about 1 to 2 inches and has nonmetallic inclusion material concentrated along the longitudinal axis of the casting and in the immediate adjacent area forming dark center and axial voids.

In FIGS. 7 and 7A which characterize Type IV internal casting structures the continuous castings have a central zone which is much larger than that of the Type I structure and do not have axial looseness, voids, or a concentration of non-metallic material along the axis which causes objectionable dark centers. The intermediate zone which extends outwardly from the central zone is consistently free of the internal cracks which can occur in the central and in the intermediate zones of Type I castings.

A continuous casting having the Type I structure would be entirely unsuited for producing elements requiring special quality steel. On the other hand, the continuous castings having the superior Type IV structure are free of significant internal structural defects, such as axial voids and segregation of impurities in the axial zone which are generally found in most prior art continuous castings, including those castings which have heretofore been considered good and acceptable.

The frequency with which the Type I and Type IV casting structures occurred in a series of continuous bloom castings (8 × 8 inches) formed of 1017 steel using (1) a straight discharge system with a submergible straight bore nozzle and (2) the multihole lateral discharge system of the present invention comprising the nozzle and the mold assembly shown in FIG. 5 of the drawing while casting at a rate of about 80 inches per minute are shown in the following Table II:

TABLE II

Distribution of Type IV and Type I Structures in 1017 Steel At Various Steel Temperatures When Using Straight Discharge System vs. Multihole Discharge Systems

| Tundish Temp. (°F) | Straight Discharge Systems | | Multihole Discharge Systems | |
|---|---|---|---|---|
| | Type I % | Type IV % | Type I % | Type IV % |
| 2760 | 0 | 100 | 0 | 100 |
| 2761–70 | 60 | 40 | 0 | 100 |
| 2771–80 | 100 | 0 | 12 | 88 |
| 2781–90 | 100 | 0 | 70 | 30 |
| 2791–2800 | 0 | 0 | 75 | 25 |
| 2800+ | 0 | 0 | 100 | 0 |

FIG. 8 of the drawing is a graphic representation of the data of Table II showing the percentage of Type IV casting structures obtained at various temperatures of metal in the tundish when using either the multihole discharge system in accordance with the present invention or a straight discharge system.

From the data of Table II and the graphs in FIG. 8 of the drawing it will be observed that the percentage of fine grained random Type IV structure increased rapidly as the temperature of the metal in the tundish was decreased below 2800°F, and particularly below about 2780°F, when using the multihole discharge system of the present invention. Continuous castings which had 88% or more thereof exhibiting superior quality internal structure were formed when the temperature of the metal (1017 steel) in the tundish was maintained at a temperature between about 2760°F and about 2780°F. Thus, the critical maximum temperature of the metal in the tundish at or below which approximately 90 to 100 percent of the castings exhibited Type IV structure when using a multihole discharge system in accordance with the present invention is 2780°F when casting 1017 steel; whereas the critical maximum temperature of the metal in the tundish employing the straight discharge system at which approximately 90 percent or more of the castings exhibited Type IV structure is about 2760°F, or about 20°F lower than the maximum temperature at which the metal cast using the multihole discharge system produces at least about 90 percent Type IV structures. None of the continuous castings made with a straight discharge system exhibited Type IV structure when the metal in the tundish was maintained at a temperature ranging between about 2771° to 2780°F or above.

With 1017 steel skulling occurred when the temperature of the metal in the tundish fell below 2760°F in both the multihole and straight bore types of discharge nozzles having a 2 inch internal diameter. Thus, the temperature 2760°F represents the minimum temperature at which 1017 steel can be maintained in the tundish and still avoid skulling. The liquidus temperature for 1017 steel containing 0.17% C, 0.50% Mn, 0.015% P, 0.025% S, and 0.25% Si is 2760°F and is in accordance with the foregoing observations.

The relationship established for 1017 steel between the temperature of the casting metal in the tundish, the liquidus temperature of the metal and the internal quality of the resulting castings was also found to hold true for 1045 steel which has a liquidus temperature of about 2720°F. The data obtained from the examination of castings produced under controlled conditions with the multiholed horizontal discharge nozzle system of the present invention indicate that the maximum tundish temperature for producing superior internal quality castings (Type IV) is about 2740°F or substantially 20°F above the liquidus temperature of the 1045 steel. All the superior (Type IV) quality 1045 steel material was produced with the multihole horizontal discharge nozzle system at a tundish temperature ranging from 2715°–2740°F.

Continuous casting data for medium carbon steels and alloy steels are more limited, but a similar relationship between the highest maximum temperature above the liquidus temperature at which these steels could be maintained in the tundish and still provide castings having good internal structure was evident when using the multihole discharge system to continuously cast medium carbon and alloy steels, such as 4140 and 8620 steels, in accordance with the present invention.

It will be evident from the foregoing that while the maximum temperature at which a ferrous metal can be maintained in the tundish and still consistently produce castings having the desirable Type IV internal structure varies with the composition of the steel or other ferrous metal being cast, it is possible with the present invention to maintain the metal in the tundish at a higher temperature and within a range of about 20°F above the liquidus, and preferably between about 5°F and 20°F above the liquidus, so that skulling can be entirely avoided and still obtain a very high percentage (i.e. 90% or more) of the castings with superior quality internal structure (Type IV) by employing the multihole discharge system in accordance with the present invention.

In each embodiment of the multihole horizontal discharge system described herein the temperature profile across the liquid core of a continuous ferrous metal casting is changed so as to greatly reduce the temperature gradient of the molten metal from the solidifying interface at the surface of the casting shell to the center of the liquid core of the casting, in contrast with the prior methods for improving heat removal which do not change the temperature gradient in the molten metal. Thus, by reducing the temperature differential between the molten metal at the central liquid core and the molten metal at the interface with the casting shell, the present multihole horizontal discharge system promotes the formation of the more desirable fine random oriented ferrous metal crystalline structure in the central portion of the casting, since a large temperature gradient in the liquid core of the casting results in the formation of a columnar dendritic crystalline structure associated with Type I interior structures.

I claim:

1. In a process of continuous casting molten ferrous metal in which molten ferrous metal is introduced into the upper end of a continuous casting mold through a feeding nozzle having one end portion submerged in a pool of the molten ferrous metal maintained in the upper end of said mold to form a ferrous metal continuous casting having an improved internal structure including being free of axial voids and concentrations of segregated impurities in the axial zone of said casting, the improvement which comprises; continuously feeding molten ferrous metal into the upper end of a continuous casting mold through the submerged end portion of said feeding nozzle while maintaining said molten metal at a temperature sufficiently above the liquidus temperature of said ferrous metal to avoid skulling in said nozzle and not so high that the temperature of the molten ferrous metal can not be reduced to at least the liquid temperature thereof before descending into the deep liquid core zone of said casting, and cooling said molten ferrous metal to at least the liquidus temperature of said ferrous metal before said molten ferrous metal descends into the deep liquid core zone of said casting and while said molten ferrous metal remains between about the upper edge of said casting and a point above the lower end of said mold about where said casting initially forms an air gap by separating from the inner surface of said mold, and said cooling being effected by discharging said molten ferrous metal laterally from said feeding nozzle disposed axially in said mold with the said molten ferrous metal flowing generally radially outwardly directly into contact with each of the interior lateral surfaces of said casting.

2. In a process of continuously casting a ferrous metal to provide a continuous billet-type casting having an improved internal structure including being free of axial voids and concentrations of segregated impurities in the axial zone of said casting in which molten ferrous metal is continuously introduced below the surface of a pool of said molten ferrous metal through a feeding nozzle maintained axially in the upper end of a billet-type continuous casting mold with said feeding nozzle having the lower end portion thereof submerged in said pool, the improvement which comprises; continuously feeding molten ferrous metal into a said billet-type continuous casting mold through said feeding nozzle with said molten metal having a temperature sufficiently above the liquidus temperature of the said ferrous metal to avoid skulling in said nozzle and not substantially in excess of about 24°F above said liquidus temperature, and effecting cooling of said molten ferrous metal to at least said liquidus temperature before said molten ferrous metal descends into the deep liquid core zone of said casting by discharging said molten ferrous metal laterally from the submerged end portion of said axial disposed feeding nozzle with the molten metal flowing generally radially outwardly directly into contact with all the interior lateral surfaces of said casting over an area extending between about the upper edge of said casting and a point about where the said casting initially forms an air gap by separating from the inner surface of said mold.

3. A process as in claim 2, wherein said molten metal substantially uniformly contacts the said interior lateral surfaces of said casting.

4. A process as in claim 2, wherein said continuously casting mold is a continuous casting bloom mold and said molten ferrous metal is fed into said mold at a temperature not substantially in excess of about 20°F above the liquidus temperature of said ferrous metal.

5. A process as in claim 4, wherein the temperature of said molten ferrous metal as fed into said continuous casting bloom mold has a temperature range between about 10°F and 20°F above the liquidus temperature of said ferrous metal.

6. A process as in claim 2, wherein said continuous casting mold is a continuous casting bloom mold in which said feeding nozzle has lateral discharge outlets immersed about six inches below the surface of said pool of molten metal with substantially all of said molten metal entering said mold flowing generally radially outwardly from said lateral discharge outlets directly into contact with all the interior lateral surfaces of the said casting over an area extending between about the uppermost edge of said casting downwardly to a point about six inches below said uppermost edge.

7. A process as in claim 2, wherein a slag layer is provided on the surface of said pool of molten metal in said mold.

* * * * *